United States Patent [19]

Lundqvist

[11] Patent Number: 4,664,790

[45] Date of Patent: May 12, 1987

[54] METHOD FOR SCREENING OF WOODEN CHIPS AND THE LIKE AND A SCREEN

[76] Inventor: Svante Lundqvist, P1 8, S-45205, Sydkoster, Sweden

[21] Appl. No.: 741,308

[22] PCT Filed: Jun. 29, 1984

[86] PCT No.: PCT/SE84/00248

§ 371 Date: Jun. 4, 1985

§ 102(e) Date: Jun. 4, 1985

[87] PCT Pub. No.: WO85/01456

PCT Pub. Date: Apr. 11, 1985

[30] Foreign Application Priority Data

Oct. 6, 1983 [SE] Sweden ..... 8305500

[51] Int. Cl.[4] ..... B07B 1/12; B07B 1/30

[52] U.S. Cl. ..... 209/395; 209/342; 209/396; 209/405; 209/674; 210/389

[58] Field of Search ..... 209/396, 395, 341, 342, 209/343, 405, 408, 393, 674; 210/389

[56] References Cited

U.S. PATENT DOCUMENTS

| | | | |
|---|---|---|---|
| 431,176 | 7/1890 | Thissell | 209/674 |
| 1,472,439 | 9/1923 | Sandoe | 209/396 |
| 1,552,397 | 9/1925 | Edwards | 209/396 X |
| 1,606,301 | 11/1926 | Jones | 209/396 |
| 1,703,726 | 2/1929 | Davis | 209/396 |
| 2,870,910 | 1/1959 | Wehner | 209/396 |
| 2,911,097 | 11/1959 | Rose | 209/393 |
| 3,023,904 | 3/1962 | Wehner | 209/396 |
| 3,515,274 | 6/1970 | Wehner | 209/396 X |
| 4,504,386 | 3/1985 | Dyren et al. | 209/396 X |
| 4,558,787 | 12/1985 | Danielsson et al. | 209/396 X |

*Primary Examiner*—S. Leon Bashore
*Assistant Examiner*—Thomas M. Lithgow
*Attorney, Agent, or Firm*—Watson, Cole, Grindle & Watson

[57] ABSTRACT

A method for screening of wooden chips and the similar stuff placed upon a vibrating conveyor including a chute (1) and a frame (2), at which the bottom (4) of the chute (1) is provided with a screening grid consisting of mutually parallel screening rods (6) and is brought to vibrate relative to the frame (2) by help of a vibrating device (11) and at which the frame (2) is provided with longish carriers (9) which are arranged projecting up between the screening rods (6) and the carriers (9), and at which the carriers (9) is brought to vibrate partly relative to the frame (2) and partly relative to the chute (1) with the screening rods. The chute (1) with the screening rods (6) is vibrating in the same plane as the carriers (9) at which the relative movement between the screening rods (6) and the carriers (9) is controlled by a mutual phase displacement of these respectively movement of vibration. The invention also includes a screen for carrying out the method at which the carriers are movable arranged on the frame (2) and connected to a vibrating device (10).

6 Claims, 2 Drawing Figures

METHOD FOR SCREENING OF WOODEN CHIPS AND THE LIKE AND A SCREEN

BACKGROUND OF THE INVENTION

1. Field of the Invention

The present invention relates to a method for screening wooden chips or similar particular materials and to a screening apparatus for carrying out the method.

A known screening apparatus includes a chute arranged upon a bottom frame, the chute being provided with an upper bottom which includes a screening grid consisting of mutual parallel screening rods, and is vibrated relative to the frame by a vibrating device. The bottom frame is provided with longish carrier elements, which are arranged to project upwardly between the screening rods so that gaps are created between the rods. When the chute is vibrating, e.g., is oscillating in a plane in its longitudinal direction, the screening rods perform a to-and-fro movement relative to the carriers, by which particulate materials with a piece size less or equal to the width of the gaps fall through the screening grid and are be picked up on a lower bottom arranged on the chute.

It has appeared that the known device has a range of application limits to certain kinds of particulate materials and that it has a limited capacity. Thus it is desired to widen the range of application of the apparatus and to increase the capacity within given limitations.

SUMMARY OF THE INVENTION

The purpose of the present invention is to satisfy the wishes mentioned above. The purpose has been achieved by an invention which is constituted by a method for screening with a screening apparatus which partly includes the same members as the known screening apparatus and which is characterized in that the carrier elements are brought to vibrate partly relative to the bottom frame and partly relative the chute with the screening rods, by which the chute preferably vibrates in the same plane as the carriers. In particular, the relative movement between the screening rods and the carriers is controlled by a mutual phase displacement, e.g., by separate vibration of each.

The invention also includes a screening apparatus which is characterized in that the carrier elements are movably arranged on the frame. Preferably, the carrier elements are connected to the frame by struts which include a spring device. The vibrating movement of the carrier elements thereby is effected by a vibration device which is attached to any of the struts. The vibration movement of the chute and the screening rods is effected by a vibration device attached on the frame and which is connected with the chute. The vibration device thereby preferably is constituted by a crank device which is driven by an electrical motor.

In an alternative embodiment of the invention, the carrier elements and the chute are vibrated by crank devices attached to the frame, whose crank motion is controllable for adjusting of a mutual phase displacement of the two vibration movements.

The carrier elements are provided with a mass, which is considerably less than the one of the chute, by which the carrier elements can be brought to vibrate moe easily and with a higher frequency than the chute. By this an intensive movement in the particulate materials to be screened will be achieved at the gap between the carrier elements and the screening rods, by which an effective screening will be achieved. The higher frequency of oscillation of the carrier elements also has proved to prevent clogging of the screening grid.

The screening method in accordance with the invention is not limited to a division of particulate materials into two fractions. By providing the chute with several bottoms, a division in several fractions can be achieved. The method is in particular useful for screening wooden chips, but is not limited to this kind of particulate materials. The method also can be used to separate gravel from wooden chips and the like.

The invention will be better understood by reference to the attached drawings which show an embodiment of the inventive apparatus for screening wooden chips.

DETAILED DESCRIPTION OF THE PREFERRED EMBODIMENT

Figure 1:
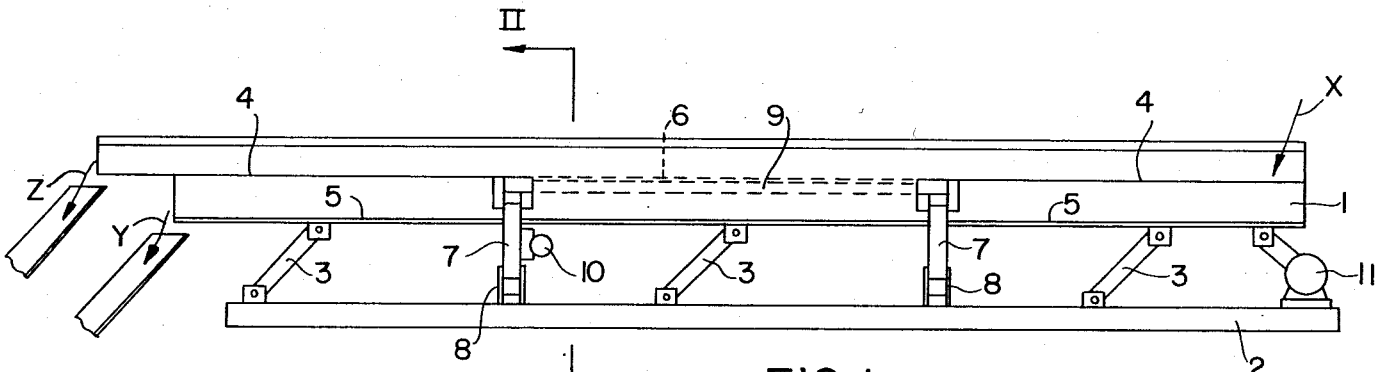
FIG. 1 schematically shows a preferred embodiment of the inventive screening apparatus for transporting and screening of wooden chips as seen from one side.
Figure 2:
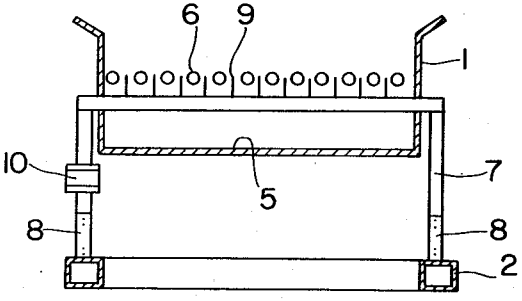
FIG. 2 shows a cross sectional view of the screen shown in FIG. 1 as seen along line II—II.

As shown in FIGS. 1 and 2, the inventive screen includes a chute 1 with an U-formed cross-section, which is carried by a frame 2 by suspension bars 3. The chute 1 is provided with an upper bottom 4 and a lower bottom 5. A screening aperture is arranged in the upper bottom 4 of the chute, which is covered by a screening grid consisting of mutually parallel screening rods 6 made of round iron.

The frame 2 further carriers two loop-formed struts 7 whose attachments in the frame 2 consist of plate springs 8 which can be bent in the longitudinal direction of the chute 1. The loop struts 7 are twistably conected by longish carrier elements 9 made of flat iron which are arranged edgeways so that one carrier elements 9 projects up between two screening rods 6 so that longitudinal gaps are created between the screening rods 6 and the carrier elements 9. At one of the loop struts 7 a vibrator 10 is arranged, which oscillations coincides with the bending plane of the plate springs 8.

The chute 1 further is connected to the frame 2 by a crank vibrator 11, which stroke length and number of revolutions can be adjusted relative to the carrier vibrator 10 whose oscillations can also be adjusted.

The wooden chips which are to be screened are feed into the chute 1 and against the upper bottom 4 as shown by arrow X in FIG. 1 and is moved by the shaking movement of the chute 1 effected by the crank arm vibrator 11 down to the screening grid where chips having a piece size less than the gap between the screening rods 6 and the carrier elements 9 fall down to the lower bottom 5 in order to be moved on by the shaking movement of the chute 1 and away from it as shown by arrow Y in FIG. 1. The coarse fraction which passes over the screening grid is moved on by the shaking movement of the chute 1 and out as shown by arrow Z in FIG. 1. The two fractions are transported away by suitable conveyors.

In an alternative embodiment of the invention, the chute 1 and the screening rods 6 are controlled relative to the loop struts 7 and the carrier elements 9 by the help of control devices, e.g. guides which are not shown in the figures. In this way the gap between the screening rods 6 and the carrier elements 9 has a constant width during the relative movement between the screening rods 6 and the carrier elements 9, which in its turn gives a more exact limit between the two fractions that are separated in the screen. Such an exact fractionation has not previously been possible to achieve for instance by help of the known screening device mentioned above, where the carrier elements are firmly connected to the base of the device and where the chute with the screening grid are not provided with any guide to the base, e.g., indirectly the carrier elements which project in the screening grid. Eventually play which arises due to wearing of the suspension attachments allows the chute and the screening grid to move also sideways, causing a varying width of the gaps between the screening grid and the carrier elements.

What is claimed is:

1. A screening apparatus which comprises a chute;

a frame;

a screening grid consisting of mutually parallel alternating rods and carriers which define longitudinal gaps therebetween, said rods being supported by said chute and said carriers being supported by struts;

first support means connected between said chute and said frame for supporting said chute above frame and for allowing relative movement between said chute and said frame;

second support means connected between said struts and said frame for supporting said struts and for allowing relative movement between said struts and said frame;

first vibration means for vibrating said chute and rods at a first frequency relative to said frame;

second vibration means for vibrating said struts and carriers at a second frequency relative to said frame, said second frequency being higher than said first frequency, said first and second vibtation means vibrating said rods and carriers in the same plane.

2. The screening apparatus as defined in claim 1, wherein said struts extend between said carriers and said second support means.

3. A screening apparatus for separating particulate materials into fractions, said screening apparatus comprising an elongated support frame, an elongated chute means positioned above said support frame, said chute means including an upper floor and a lower floor, said upper floor defining a screening aperture therein and including parallel, uniformly spaced apart rods extending across said screening aperture in the elongated direction of said chute means, and said lower floor being imperforate, first means for movably supporting said chute means above said support frame and for vibrating said chute means relative to said support frame at a first frequency, a plurality of parallel carrier elements positioned above said support frame so as to extend in parallel with said rods, each of said carrier elements extending between adjacent rods in the screening aperture of said upper floor so as to define longitudinal screening gaps in said screening aperture, said rods and said carrier elements forming a screening grid, and second means for movably supporting said carrier elements above said support frame and for vibrating said carrier elements relative to said support frame at a second frequency, said second frequency being different from said first frequency.

4. A screening apparatus as defined in claim 3, wherein said first means includes a plurality of suspension bars and a crank vibrator.

5. A screening apparatus as defined in claim 3, wherein said second means includes a plurality of struts; a plurality of plate springs, each plate spring supporting a respective strut on said support frame; and a vibrating device attached to one of said struts.

6. A screening apparatus as defined in claim 3, wherein each of said carrier elements comprises an elongated flat strip and each elongated flat strip is supported above said support frame such that its width dimension is vertically oriented.

* * * * *